United States Patent [19]

Lai et al.

[11] 4,454,060

[45] Jun. 12, 1984

[54] LIQUID DETERGENT COMPOSITION WITH A CATIONIC FOAM STABILIZING COPOLYMER CONTAINING PENDANT QUATERNARY NITROGEN GROUPS AND PENDANT HYDROPHOBIC GROUPS

[75] Inventors: Kuo-Yann Lai, Kendall Park; Robert C. Pierce, Plainsboro, both of N.J.; Jean Dupré, Levittown; H. Scott Killam, Holland, both of Pa.

[73] Assignee: Colgate-Palmolive Company, New York, N.Y.

[21] Appl. No.: 502,876

[22] Filed: Jun. 9, 1983

[51] Int. Cl.[3] ..... C11D 1/62; C11D 17/08

[52] U.S. Cl. ..... 252/547; 252/DIG. 2; 252/DIG. 5; 252/DIG. 13; 252/DIG. 14; 252/153; 252/173; 252/553; 252/174.23; 252/174.24; 252/528; 424/70; 526/287; 526/291

[58] Field of Search ..... 252/DIG. 2, DIG. 5, 252/DIG. 13, DIG. 14, 528, 547, 174.23, 174.24, 153, 173, 553, 548; 424/70; 526/287, 291

[56] References Cited

U.S. PATENT DOCUMENTS

| | | | |
|---|---|---|---|
| 2,808,349 | 10/1957 | Melamed | 526/291 |
| 3,332,904 | 7/1967 | Combe et al. | 526/287 |
| 3,341,505 | 9/1967 | Gander | 526/287 |
| 3,411,912 | 11/1968 | Dykstra | 526/287 |
| 3,723,358 | 3/1973 | Morgan et al. | 252/174.24 |
| 4,234,381 | 11/1980 | Killam | 162/158 |

*Primary Examiner*—Roland E. Martin, Jr.
*Assistant Examiner*—Hoa Van Le
*Attorney, Agent, or Firm*—Herbert S. Sylvester; Murray M. Grill; Norman Blumenkopf

[57] ABSTRACT

A foaming light duty aqueous liquid detergent composition especially useful for hand dishwashing containing 5 to 50 wt. % of non-cationic detergent active material, optional foam boosters and hydrotropes, and 0.1 to 10 wt. % of a cationic foam-stabilizing copolymer containing a major weight proportion of units derived from acrylamide and/or methacrylamide, about 0.5 to 2 wt. % of quaternary nitrogen as present in quaternary ammonium groups, and about 0.1 to 10 wt. % of pendant $C_{8-24}$ hydrophobic, preferably alkyl groups.

Said quaternary ammonium group-containing monomer has the formula

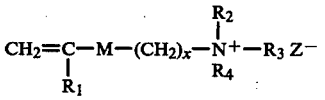

wherein $R_1$ is H or $CH_3$,
$R_2$ and $R_3$ are independently $C_{1-4}$ alkyls,
$R_4$ is $C_{1-4}$ akyl, $C_{2-3}$ hydroxyalkyl, or benzyl
$R_2$, $R_3$ and $R_4$ together contain less than 9 carbon atoms,
Z is a water-solubilizing salt-forming anion, and
M may be —CO—X—, then X is —O— or —$NR_5$—, $R_5$ is H or $C_{1-4}$ alkyl and x is 1–6, or
M may be phenylene then x is 1, said hydrophobic group-containing monomer has the formula

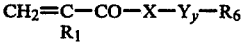

wherein $R_1$ is H or $CH_3$,
X is —O— or —$NR_7$—,
Y is —$C_2H_4O$— or —$C_3H_7O$—,
Y is 0–60,
when X is —O—, $R_6$ is $C_{8-24}$ hydrocarbyl, and
when X is —$NR_7$-, $R_6$ is $C_{1-24}$ hydrocarbyl and $R_7$ is H or $C_{1-24}$ hydrocarbyl, at least one of $R_6$ and $R_7$ being $C_{8-24}$ hydrocarbyl.

20 Claims, No Drawings

LIQUID DETERGENT COMPOSITION WITH A CATIONIC FOAM STABILIZING COPOLYMER CONTAINING PENDANT QUATERNARY NITROGEN GROUPS AND PENDANT HYDROPHOBIC GROUPS

This invention relates to foaming liquid detergent compositions and especially to such compositions of the light duty, essentially builder-free type containing a cationic polymeric foam stabilizer.

Light duty liquid detergent compositions commonly employed for handwashing dishes, kitchen utensils and the like, are well known and have met with a high degree of public acceptance because of their generally good washing and foaming properties and convenient form of use. Most of the formulations in commercial use at the present time are based on synthetic organic detergents together with often conventional adjuvants. Detergency, foaming, foam stability clarity, skin compatibility, and/or viscosity characteristics and the like of such formulations have of course always been considered as less than optimal and capable of improvement.

It is an object of this invention to provide a light duty liquid detergent composition, one or more of the aforementioned characteristics of which are unexpectedly improved. Other objects and advantages will appear as the description proceeds.

The attainment of such object is made possible by this invention which includes the provision of a liquid detergent composition consisting essentially of an aqueous medium containing, approximately by weight, 5 to 50% of organic foaming non-cationic detergent material, 0 to 20% aromatic sulfonate hydrotrope, 0 to 8% of $C_{10-18}$ alkanoic acid $C_{2-4}$ alkanolamide foam stabilizer, and 0.1 to 10% of a cationic foam-stabilizing copolymer containing, approximately by weight, more than 50% of units derived from acrylamide, methacrylamide or a mixture thereof, 0.5 to 2% of pendant quaternary nitrogen, and 0.1 to 10% of pendant $C_{8-24}$ hydrophobic groups.

All of the components of the above defined compositions of this invention are more or less conventional in light duty liquid detergent compositions except the defined copolymer, the latter term being employed herein as referring to a linear polymer derived from the polymerization of a plurality (preferably two or three) of different polymerizable monoethylenically unsaturated monomers. It has been found that the inclusion of said defined copolymer in these compositions is unexpectedly effective in providing such compositions with improved detergency, foaming, foam stability, clarity, skin compatibility and/or viscosity characteristics and the like.

The copolymers of this invention are linear, the backbone chain generally consisting of carbon atoms, optionally interspersed with small amounts, e.g. up to about 10 mole percent, of heteroatoms such as S, N, O and the like. The quaternary nitrogen and $C_{8-24}$ hydrophobic groups are pendant, i.e. in or as side chains or branches. The quaternary nitrogen is present in the form of quaternary ammonium groups, and the said hydrophobic groups are hydrocarbyl aralkyl, e.g. nonylphenyl, octylnaphthyl or the like, or preferably aliphatic, branched or preferably straight chain, unsaturated or preferably saturated, i.e. alkyl such as octyl, octadecyl, didodecyl etc. The copolymer thereby contains a critical balance of hydrophobic and hydrophilic groups effective to provide one or more of the aforementioned desired improved characteristics.

According to a first preferred embodiment of this invention, said copolymer contains, approximately by weight, 55 to 95% of units derived from acrylamide, methacrylamide or a mixture thereof, 4 to 30% of hydrophilically functional units having the molecular configuration of units derived from at least one monoethylenically unsaturated, quaternary ammonium group-containing monomer, and 1 to 15% of units derived from at least one monoethylenically unsaturated, $C_{8-24}$ hydrophobic group-containing monomer devoid of quaternary nitrogen.

In the aforesaid first preferred embodiment, said quaternary ammonium group-containing monomer preferably has the formula:

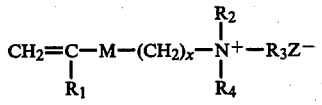

I wherein $R_1$ is H or $CH_3$, $R_2$ and $R_3$ are independently $C_{1-4}$ alkyls, $R_4$ is $C_{1-4}$ alkyl, $C_{2-3}$ hydroxyalkyl, or benzyl, $R_2$, $R_3$ and $R_4$ together contain less than 9 carbon atoms, Z is a water-solubilizing salt-forming anion, and M may be —CO—X—, then X is —O— or —$NR_5$—, $R_5$ is H or $C_{1-4}$ alkyl and x is 1–6, or M may be phenylene than x is 1.

Preferably in the monomer of formula I above, $R_1$, $R_2$, $R_3$ and $R_4$ are $CH_3$, M is —CONH—, x is 3, and Z is Cl, corresponding to methylacrylamidopropyl trimethyl ammonium chloride (MAPTAC). Other monomers of formula I may however be employed in which $R_2$ and $R_3$ may be methyl, ethyl, n- or iso-propyl or -butyl, $R_4$ may be like $R_2$ or $R_3$ or hydroxyethyl or hydroxypropyl, Z may be any common anion such as sulfate, nitrate or halide, and $R_5$ may be like $R_2$ or $R_3$ or H. As illustrative of such other monomers, mention may be made of methacryloxethyltrimethylammonium chloride, methacryloxyethyldimethylbenzylammonium chloride, methacryloxyethyldimethylbutylammonium chloride and their acryloxy analogs, vinylbenzyltrimethylammonium chloride, vinylbenzyldimethylbenzylammonium chloride, vinylbenzyldimethylethylammonium chloride, allylmethylethylhydroxyethylammonium chloride, allyltrimethylammonium chloride, allyldimethylbenzylammonium chloride, allyldimethylethylammonium chloride, methacrylamidohexyl- and methacrylamidomethyltrimethylammonium chloride, methacrylamidopropyldimethylbenzylammonium chloride, methylacrylamidopropyldimethylethylammonium chloride, and their acrylamido analogs, and the corresponding sulfates methyl sulfates, nitrates, phosphates, and other anions and the like.

Also, in the aforesaid first preferred embodiment, said hydrophobic group-containing monomer preferably has the formula:

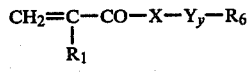

II wherein $R_1$ is H or $CH_3$,

X is —O— or —$NR_7$—,

Y is $—C_2H_4O—$ or $—C_3H_7O—$, y is 0–60, when X is —O—, $R_6$ is $C_{8-24}$ hydrocarbyl, and when X is $—NR_7—$, $R_6$ is $C_{1-24}$ hydrocarbyl and $R_7$ is H or $C_{1-24}$ hydrocarbyl, at least one of $R_6$ and $R_7$ being $C_{8-24}$ hydrocarbyl.

Preferably in the monomers of formula II above, X is —O—, Y is $—C_2H_4O—$ (meaning ethylenoxy or EO), y is 20, $R_1$ is $CH_3$ and $R_6$ is octadecyl or $C_{16-18}$ alkyl, corresponding to stearyl $(OE)_{20}$ methacrylate (SE-20-MA). Other monomers of formula II may however be employed in which $R_6$ and $R_7$ may be $C_1$ to $C_{24}$ hydrocarbyl, preferably n-alkyl, at least one of $R_6$ and $R_7$ containing at least 8 C atoms, Y may be $—C_3H_7O—$ (meaning propyleneoxy or PrO), etc. As illustrative of such other monomers, mention may be made of

| | |
|---|---|
| $C_8$ alkyl $(OE)_2$ | acrylate or methacrylate |
| $C_{24}$ alkyl $(OE)_{60}$ | acrylate or methacrylate |
| $C_{10}$ alkyl | acrylate or methacrylate |
| N—[$C_{18}$ alkyl $(OE)_8$] | acrylamide or methacrylamide |
| N—[$C_8$ alkyl $(OPr)_4$] | acrylamide or methacrylamide |
| N—$C_{10}$ alkyl | acrylamide or methacrylamide |
| N, N—bis ($C_8$ alkyl) | acrylamide or methacrylamide |

According to a second preferred embodiment of the invention, the copolymer in the compositions of this invention contains, approximately by weight, 85 to 97% of units derived from acrylamide, methacrylamide or a mixture thereof and 3 to 15% of units having the molecular configuration of units derived from at least one monoethylenically unsaturated monomer containing quaternary ammonium and $C_{8-24}$ hydrophobic groups.

In the aforesaid second preferred embodiment, said unsaturated monomer containing both quaternary ammonium and $C_{8-24}$ hydrophobic groups preferably has the formula:

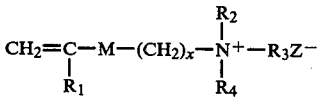

III wherein $R_1$ is H or $CH_3$, $R_2$ and $R_3$ are independently $C_{1-4}$ hydrocarbyl $R_4$ is $C_{8-24}$ hydrocarbyl, Z is a water solubilizing salt-forming anion, and M may be —CO—X—, then X is —O— or $—NR_5—$, $R_5$ is H or $C_{1-4}$ alkyl and x is 1–6, or M may be phenylene, then x is 1.

Preferably in the monomer of formula III above, $R_1$, $R_2$ and $R_3$ are $CH_3$, $R_4$ is dodecylbenzyl, M is —CONH—, x is 3, and Z is Cl, corresponding to methacrylamidopropyl dimethyl dodecylbenzyl ammonium chloride (MAPDDBzAC), or $R_1$ is H, $R_2$ and $R_3$ are $CH_3$, $R_4$ is tetradecyl, M is phenylene, x is 1 and Z is Cl, corresponding to tetradecyl dimethyl vinylbenzyl ammonium chloride (TDVBzAC). Other monomers of Formula III may however be employed, as illustrative of which may be mentioned methacrylamidohexyl dimethyl octyl- and $C_{24}$ alkyl-ammonium chlorides, methylacrylamidomethyl ethyl isobutyl octadecyl ammonium chloride, N-methylmethacrylamidopropyl dimethyl hexadecylbenzyl ammonium chloride, acrylamido, acryloxy, methacrylamido analogs, $C_8$ alkyl- and $C_{24}$ alkyl-dimethyl vinylbenzyl ammonium chloride, and the corresponding sulfates, methylsulfates, nitrates, phosphates and other anions and the like.

A preferred copolymer for use in the compositions of this invention contains, approximately by weight, 70 to 90% of units derived from acrylamide, 8 to 25% of units derived from methacrylamidopropyl trimethyl ammonium chloride, and 1 to 8% of units derived from stearyl (oxyethylene)$_{20}$ methacrylate.

It will be understood that in formulae I and III above, $R_2$ and $R_3$ may be joined directly or through hetero atoms such as O, S and/or N to form a heterocycle with the depicted N atom without departing from the spirit and scope of this invention. It will also be understood that the molecular configuration of the copolymer units derived from monomers of formulae I and III may be achieved within the scope of this invention by employing in the copolymerization step the precursor non-quaternized tertiary amine form of the monomers (devoid of $R_2Z$, $R_3Z$ or $R_4Z$), and post-quaternizing by reacting the resulting copolymer with the $R_2Z$, $R_3Z$ or $R_4Z$ alkylating agent.

The molecular weight of the copolymers employed herein is not critical, but being difficult to determine directly, may be preferably defined as such as will produce a relative viscosity for a 2.0% solids, by weight, solution of the copolymer in water of about 5–100 centipoises, as measured with a Brookfield Model LVF viscometer at 60 rpm, spindle selection being within the skill of the operator and based on obtaining an acceptable scale reading as described in the Brookfield Manual.

These copolymers are produced in known manner by vinyl addition polymerization in an aqueous system in the presence of any known effective free radical polymerization initiator. Examples of such initiators include tert.butyl hydroperoxide, ammonium, sodium and potassium persulfates, perborates and percarbonates, peroxides and the like. Customary dosages are about 0.1 to 2% by weight of the monomers. They may be used with sodium hydrosulfite or other reducing agents in redox systems. The use of elevated temperatures facilitates and expedites completion of the polymerization. The polymerization may be effected by radiation or by heavy-metal activated catalyst systems. Desirably, the aqueous medium resulting from the polymerization reaction may be employed directly without polymer isolation for admixture with the other components of the compositions of this invention.

The above-defined copolymer unit components are randomly distributed in the polymer chain, with the units derived from acrylamide and/or methacrylamide predominating on a weight basis. Since the latter units generally if not always have a molecular weight lower than the other defined unit components providing the required quaternary nitrogen and $C_{8-24}$ hydrophobic groups, the proportion or percent of acrylamide and/or methacrylamide units in the polymer chain is generally if not always significantly higher on a mol basis than on a weight basis. It will be understood that without significantly affecting the above-defined weight percent ranges of the defined copolymer units, the copolymer chain may contain minor non-interfering amounts of units having the molecular configuration of non-interfering units derived from other, different, polymerizable monoethylenically unsaturated monomers.

The organic foaming non-cationic detergent active material, present in the compositions of this invention in a weight range of about 5 to 50%, preferably about 20 to 40%, are well known and profusely documented in the prior art, such as Surface Active Agents and Detergents Vol. II, by Schwartz, Perry and Berch (1958, Interscience Publishers, Inc.) and McCutcheon's Detergents and Emulsifiers Annuals (1969, 1970 and later). They include the well known generally water-soluble anionic, nonionic, zwitterionic and amphoteric surface active detergents, and any mixtures thereof, as described in detail in U.S. Pat. No. 4,076,800, column 7, line 10 to column 10, line 41, which passages are incorporated herein by reference to avoid needless repetition. The following discussion is accordingly to be considered as presented in exemplification explanation and/or supplementation of such passages.

Typically, the anionic surface active detergents are the generally water-soluble salts of carboxylates, phosphates, phosphonates, and preferably sulfates and sulfonates of compounds containing a hydrophobic group to provide the desired HLB (hydrophilic lipophilic balance) values, such group being generally a $C_{8-24}$ unsaturated but preferably saturated, branched but preferably straight chain, aliphatic hydrocarbyl (alkyl). The anionic detergents preferred for use in the compositions of this invention are the salts of $C_{10-20}$ alkyl benzene sulfonates, $C_{10-20}$ alkyl (oxyethylene)$_{2-30}$ sulfates, $C_{10-20}$ alkyl sulfates, paraffin sulfonates and mixtures thereof, especially mixtures of salts of $C_{10-20}$ alkyl benzene sulfonates and $C_{10-20}$ alkyl (oxyethylene)$_{2-30}$ sulfates in an approximate weight ratio of 1:1 to 2:1, and mixtures of paraffin sulfonates and the latter sulfates in weight ratios of about 3:1 to 6:1.

The cations in these anionic detergents are well known, being preferably alkali metal such as potassium and especially sodium, and/or ammonium. Other suitable cations include for example alkaline earth metals such as magnesium and calcium, and lower substituted ammonium such as those containing one, two or three lower (e.g. $C_{1-4}$) alkyl and/or alkanol groups (methyl, ethanol, propyl, isopropanol, etc.).

The nonionic detergents are most often the condensation products of a plurality of moles of ethylene oxide with an organic compound containing a $C_{8-24}$ hydrophobic group and a labile or reactive H atom as in OH, COOH, $COHN_2$, $SO_2NH_2$, etc. Those preferred are the polyethoxyethylenated (5–30) $C_{8-24}$ alkanols. Also included in this category of detergents are the semi-polar nonionic organic oxides such as those described in U.S. Pat. No. 4,076,800. In a semi-polar type nonionic detergent, the hydrophilic group contains a semi-polar bond between 2 atoms, e.g. N→O, P→O, As→O and S→O, the arrow being the conventional representation of a semi-polar bond. There is a charge separation between the 2 directly bonded atoms, but the molecule bears no net charge and does not dissociate into ions. Illustrative types are amineoxides of the formula $R^1R^2R^3N\rightarrow O$, phosphine oxides of the formula $R^1R^2R^3P\rightarrow O$, and sulfoxides of the formula $R^1R^2S\rightarrow O$ wherein $R^1$ is or contains $C_{8-24}$ alkyl, alkenyl or alkanol group and $R^2$ and $R^3$ are independently $C_{1-3}$ alkyl or alkanol.

An anionic/nonionic detergent mixture is often preferred, for example paraffin sulfonates, $C_{10-20}$ alkyl (oxyethylene)$_{2-30}$ sulfates and polyoxyethylenated (5–30 O.E.) $C_{8-24}$ alkanols in respective weight ratios of about 20–12:4–2:1.

The ampholytic and zwitterionic surface active detergents are also described in said U.S. Pat. No. 4,076,800 and include the well known betaine and sulfobetaine detergents.

The compositions of this invention may contain 0 to about 8 wt. %, preferably about 2 to about 5 wt. % of the known foaming, foam stabilizing, viscosity increasing $C_{10-18}$ alkanoic acid lower alkanolamides. Those preferred are the mixtures of $C_{12-14}$ alkanoic derivatives, wherein the proportion of lauric acid to myristic acid ranges from about 3:1 to 1:3, preferably about 1:1. The lower alkanolamide groups may be monoalkanolamides or dialkanolamides and usually the alkanol contains 2 to 4 C atoms, preferably being ethanol. A preferred material of this type is a lauric/myristic diethanolamide and/or especially monoethanolamide mixture, or mixtures thereof.

These compositions may also contain 0 to about 20 wt. %, preferably about 3 to about 12 wt. % of the known water-solubilizing, viscosity controlling aromatic sulfonate hydrotropes such as xylene, cumene or toluene sulfonate salts or any mixtures thereof. The cations in these salts are also well known and similar to those referred to above in the anionic detergents. Sodium and ammonium salts are preferred.

The water in the aqueous medium is present in the compositions of this invention is weight proportions of about 20 to about 80%, preferably about 35 to about 65%, being desirably combined with up to about 20 wt. %, preferably about 3 to about 10 wt. %, of a water soluble solvent, preferably a lower $C_{2-4}$ mono- or dihydroxy alcohol, more preferably ethanol. Other generally $C_{2-8}$ solvents include for example isopropanol, butanol, methyl propanol-1 and -2, pentanol, ethylene glycol, propylene glycol, butylene glycol and their monomethyl and monobutyl ethers, diethylene glycol dimethyl ether and the like.

The present compositions are homogeneous, free-flowing, opaque, translucent but preferably clear liquid solutions preferably having a viscosity of about 50 to 600 centipoises as measured with a Model LVF Brookfield Viscosimeter using Spindle No. 1 at 12 rpm and 77° F. The desired viscosity is readily controlled by suitable adjustment of the proportions of the aforementioned components, especially the alkanolamide foam stabilizer, aromatic sulfonate hydrotrope and solvent components. Sodium nitrate and/or formate in small amounts may also be added as fluidizers or viscosity controlling agents, sodium formate further providing resistance to surface filming on the dishes and utensils.

Minor amounts, up to about 10 wt. %, preferably up to about 5 wt. % of conventional non-toxic dermatoligically acceptable adjuvants may be included, for example opacifiers such as stearic monoethanolamide and ethylene glycol distearate, buffers normally desired to maintain the pH of the product in the range of about 4–9, preferably about 5.5–7.5, such as borax and citric acid, thickeners, perfumes, coloring material, optical brighteners, U.V. absorbers, humectants, preservatives, disinfectants, germicides, sequestrants such as ethylenediamine tri- and tetra-acetic acids, salts such as sodium and potassium chlorides and sulfates, tarnish and corrosion inhibitors, emollients and other skin beneficiators and the like.

The liquid compositions of this invention are employed in normal manner for washing dishes and kitchen utensils and the like, a sufficient amount (from a few drops to a squirt or capful or more) being added to the wash water to provide the desired degree of detergency and foaming, generally about 0.02 to about 0.5 wt. %, preferably about 0.03 to about 0.3 wt. %, in the wash water. Unexpectedly beneficial results are obtained in hard water, such as that having a hardness of 100 to 500 ppm, preferably about 100 to 300 ppm as $CaCO_3$. When washing with relatively soft water, it is often beneficial to include in the composition a small amount of magnesium sulfate. The wash water is generally at elevated temperatures of about 40° to 60° C., and a pH of about 4–9, preferably about 5.5 to 7.5. During the period of washing, which may take from several seconds up to several minutes, a stable copious foam of desirable consistency and appearance is obtained and the dishes and the like are washed clean.

Although the foregoing description has been directed to the production of light duty liquid dishwashing compositions, it will be understood that the compositions of this invention are effective foaming detergents for other purposes, being especially advantageous for uses involving contact between the detergent and keratin, including human skin and hair, such as hair shampoos, bubble baths, liquid hair and skin cleansers, and the like.

The following examples are illustrative of preferred embodiments of the copolymers employed in the compositions of this invention, and methods for producing such copolymers.

I

This example illustrates the preparation of a typical copolymer from 75% acrylamide (AM), 20% methacrylamidopropyltrimethylammonium chloride (MAPTAC) and 5% octadecylpoly(oxyethyl)-20-methacrylate (SE-20-MA). To a 2-liter flask fitted with a stirrer, condenser, thermometer and nitrogen inlet tube are charged 1400 g. deionized water, 56 g. acrylamide, 30 g. of a 50% solids solution of MAPTAC and 3.8 g. of SE-20-MA. The mixture is heated to 80–82 C. while sweeping the flask with a slow stream of nitrogen. When the temperature reaches 80–82 C., a solution of 0.15 g. ammonium persulfate dissolved in 10 g. of water is added. The reaction mixture is stirred at 80–82 C. for 5 to 5.5 hours, and then allowed to cool to 70 C., at which time residual monomer is removed by addition of a solution of 0.5 g. t-butyl hydroperoxide in 10 g. deionized water, followed by a solution of 0.5 g. sodium sulfoxylate formaldehyde in 10 g. deionized water. The solids content of the resulting polymer solution is 5.0% and the viscosity is 55 cps. (Brookfield LVF Viscometer, Spindle 1, 60 rpm).

II

This example illustrates preparation of a polymer from 88.1% AM, 10% MAPTAC and 1.9% SE-20-MA. To a five-gallon reactor fitted with a thermometer, stirrer, condenser and nitrogen inlet tube is charged 14,500 g. deionized water, 1760 g. acrylamide, 400 g. MAPTAC and 38.4 g. of SE-20-MA. While the batch is heated to 60–62 C. under a nitrogen blanket, a solution of 0.17 g. copper sulfate pentahydrate in 20 g. deionized water is added. When the reactor temperature reaches 60–62 C., a solution of 0.47 g. isoascorbic acid in 25 g. deionized water is added.

After this is mixed into the reaction mixture, a solution of 10 g. ammonium persulfate in 25 g. water is added. The temperature is allowed to rise to 88 C., and then to cool to 60–65 C., following which a solution of 2 g. t-butyl hydroperoxide in 130 g. deionized water, and about 3–5 minutes later a solution of 2 g. isoascorbic acid in 130 g. deionized water, are added. The solids content of the product is 11.7%, and the viscosity is 3200 cps. (Brookfield Model LVF Viscometer, Spindle 4, 60 rpm).

III

This example illustrates the preparation of a polymer from 85% AM, 10% MAPTAC and 5% methacrylamidopropyldimethyldodecyl benzylammonium chloride. The procedure of Example I is repeated, except that 63.7 g. of AM, 15 g. of the 50% solids MAPTAC solution and 3.8 g. of methacrylamidopropyldimethyldodecylbenzylammonium chloride are used.

IV

This example illustrates the preparation of a polymer from 95% AM and 5% tetradecyldimethylvinylbenzylammonium chloride. The procedure of Example I is repeated except that 71 g. AM and 4 g. tetradecyldimethylvinylbenzylammonium chloride are used.

V

This example illustrates the preparation of a polymer from 75% AM, 20% MAPTAC and 5% dodecylacrylamide. The procedure of Example I is repeated, except that 60.0 g. AM, 32.0 g. of the 50% solids MAPTAC solution and 4 g. of dodecylacrylamide are used.

The following examples are illustrative of light duty liquid detergent compositions according to this invention, and their comparative foaming and dishwashing properties relative to similar compositions devoid of the indicated cationic copolymers when tested as described below. All amounts and proportions referred to herein and in the appended claims are by weight unless otherwise indicated.

In the Tergotometer Foam Test results in Tables 1, 2 and 3, soiled planchets (1" diameter and ⅛" high), each carrying 1 gram of Crisco® soil, are added in timed increments (every 2 minutes) to an 0.1% aqueous test solution of 150 ppm hardness as $CaCO_3$(Ca/Mg=2/1) and 100 ppm alkalinity as $HCO_3^-$ at a temperature of 50° C., and agitated at 75 rpm for 1 minute. The foam level is recorded when the agitation is stopped after each addition of planchets, and the total number of planchets required to kill the foam is recorded.

In the hand dishwashing test results listed in Table 4, ceramic dinner plates having a diameter of 9.5" soiled with 4 grams of Crisco are hand-washed at 40 second intervals in a dishpan containing 12 grams (0.02%) of the test liquid detergent composition dissolved in 6 liters of water of 100 ppm and 300 ppm hardness at a temperature of about 46 C. A layer of foam is generated by allowing the 6 liters of water to fall from a separatory funnel mounted 16" above the bottom of the dishpan into a Petri dish containing the liquid test composition which is located in the center of the dishpan. The Petri dish is removed carefully and the foam height is measured prior to the start of the test. A soiled dish is placed in the solution every 30 seconds and is washed by the operator for 10 to 15 seconds while holding it about half in and half out of the solution. Washing is continued until about one half of the surface of the dishpan is covered with foam. Usually a control is run at the same time as the test composition in order to eliminate any differences due to different operators. Results are reproducible and a difference of 2 plates is significant.

The following copolymers are used in the tests.

Polymer A contains units derived from acrylamide (AM) and tetradecyl dimethyl vinylbenzenyl ammonium chloride ($TDVB_3AC$) in weight proportions of 95/5 by the procedure of Example IV above.

Polymer B contains units derived from AM, methacrylamido-propyl trimethyl ammonium chloride (MAPTAC), and dodecyl dimethyl vinylbenzyl* ($DDVB_3AC$) in respective weight proportions of 75/20/5 by the procedure of Example I above.

*Ammonium chloride

Polymer C contains AM, MAPTAC and methacrylamidopropyl dimethyl dodecylbenzyl ammonium chloride ($MAPDDB_3AC$) in respective weight proportions of 75/20/5 by the procedure of Example III.

Polymer D contains units derived from AM, MAPTAC, and dodecyl acrylamide (DAM) in respective weight proportions of 75/20/5 by the procedure of Example V above.

Polymer E contains units derived from AM, MAPTAC, and stearyl $(oxyethylene)_{20}$ methacrylate (SE-20-MA) in respective weight proportions of 75/20/1 by the procedure of Example I above.

Polymer F contains units derived from AM, MAPTAC and SE-20-MA in respective weight proportions of 87.5/10/2.5 by the procedure of Example II above.

TABLE 1

| Tergotometer Foam Performance | | | | | | | |
|---|---|---|---|---|---|---|---|
| | Example | | | | | | |
| Component - Wt. % | Control | 1 | 2 | 3 | 4 | 5 | 6 |
| LDBS[1] | 17 | 17 | 17 | 17 | 17 | 17 | 17 |
| AEOS[2] | 13 | 13 | 13 | 13 | 13 | 13 | 13 |
| Polymer A | | 2 | | | | | |
| Polymer B | | | 2 | | | | |
| Polymer C | | | | 2 | | | |
| Polymer D | | | | | 2 | | |
| Polymer E | | | | | | 2 | |
| Polymer F | | | | | | | 2 |
| Ethanol | 6.7 | 6.7 | 6.7 | 6.7 | 6.7 | 6.7 | 6.7 |
| Water, deionized | 62.3 | 60.3 | 60.3 | 60.3 | 60.3 | 60.3 | 60.3 |
| Perfume/Color, 10/1 | Balance to 100% | | | | | | |
| Planchets Washed | 12 | 20 | 18 | 18 | 17 | 20 | 21 |

[1]Linear dodecyl benzene sulfonate, sodium salt
[2]$C_{12-15}$ alkyl $(oxyethylene)_3$ sulfate, ammonium salt

TABLE 2

| Tergotometer Foam Performance | | | | | | | |
|---|---|---|---|---|---|---|---|
| | Example | | | | | | |
| Component - Wt. % | Control | 7 | 8 | 9 | 10 | 11 | 12 |
| AEOS | 12 | 12 | 12 | 12 | 12 | 12 | 12 |
| ALS[3] | 8 | 8 | 8 | 8 | 8 | 8 | 8 |
| Betaine[4] | 2 | 2 | 2 | 2 | 2 | 2 | 2 |
| Polymer A | | 1 | | | | | |
| Polymer B | | | 1 | | | | |
| Polymer C | | | | 1 | | | |
| Polymer D | | | | | 1 | | |
| Polymer E | | | | | | 1 | |
| Polymer F | | | | | | | 1 |
| Na xylene sulfonate | 5 | 5 | 5 | 5 | 5 | 5 | 5 |
| Ethanol | 6.6 | 6.6 | 6.6 | 6.6 | 6.6 | 6.6 | 6.6 |
| Water, deionized | 65.4 | 64.4 | 64.4 | 64.4 | 64.4 | 64.4 | 64.4 |
| Perfume/Color, 10/1 | Balance to 100% | | | | | | |
| Planchets Washed | 12 | 16 | 17 | 18 | 19 | 17 | 20 |

[3]Ammonium lauryl sulfate
[4]Cocoamido propyl dimethyl betaine

TABLE 3

| Tergotometer Foam Performance | | | | | | |
|---|---|---|---|---|---|---|
| | Example | | | | | |
| Component - Wt. % | Control a | 13 | 14 | Control b | 15 | 16 |
| Na paraffin sulfonate | 32 | 32 | 32 | 32 | 32 | 32 |
| AEOS | 6 | 6 | 6 | 6 | 6 | 6 |
| NI[5] | | | | 2 | 2 | 2 |
| Polymer E | | 2 | | | 2 | |
| Polymer F | | | 2 | | | 2 |
| Ethanol | 3.8 | 3.8 | 3.8 | 3.8 | 3.8 | 3.8 |
| Water, deionized | 57.2 | 55.2 | 55.2 | 57.2 | 55.2 | 55.2 |
| Perfume/Color, 10/1 | Balance to 100% | | | | | |
| Planchets Washed | 11 | 16 | 14 | 12 | 18 | 20 |

[5]Nonionic $C_{9-11}$ alkyl $(oxethylene)_8$ OH

TABLE 4

| Hand Dishwashing Foam Performance | | | | | | | | | |
|---|---|---|---|---|---|---|---|---|---|
| | Example | | | | | | | | |
| Component - Wt. % | Control a | 17 | 18 | Control b | 19 | 20 | Control c | 21 | 22 |
| LDBS | 17 | 17 | 17 | | | | | | |
| AEOS | 13 | 13 | 13 | 6 | 6 | 6 | 6 | 6 | 6 |
| Na paraffin sulfonate | | | | 32 | 32 | 32 | 32 | 32 | 32 |
| N.I. | | | | | | | 2 | 2 | 2 |
| Polymer E | | 2 | | | 2 | | | 2 | |
| Polymer F | | | 2 | | | 2 | | | 2 |
| Perfume/Color, 10/1 | 1 | 1 | 1 | 1 | 1 | 1 | 1 | 1 | 1 |
| Ethanol | 6.7 | 6.7 | 6.7 | 3.8 | 3.8 | 3.8 | 3.8 | 3.8 | 3.8 |
| Water, deionized | | | | Balance to 100% | | | | | |
| Plates Washed at 100 ppm | 12 | 15 | 16 | | | | | | |
| Plates Washed at 300 ppm | 13 | 18 | 18 | 19 | 25 | 23 | 18 | 24 | 26 |

The results in Tables 1–4 above plainly establish the unexpected improvement in foaming properties obtained by inclusion of the defined cationic copolymers in the light duty liquid detergent compositions of this invention. Following are additional examples of formulations according to this invention.

| | Example (Wt. %) | |
|---|---|---|
| Component | 23 | 24 |
| LDBS | 17.0 | 17.0 |
| AEOS | 13.0 | 13.0 |
| Na cumene sulfonate | 7.4 | |
| Na xylene sulfonate | 2.4 | 5.2 |
| Ethanol | 5.8 | 5.6 |
| Lauric/myristic monoethanolamide, 1/1 | 4.0 | |
| Polymer G[6] | 2.0 | 2.0 |
| Na nitrate | 2.0 | |
| Na formate | 1.5 | 2.0 |
| Mg sulfate | 0.5 | 0.5 |
| EDTA $Na_3$[7] | 0.008 | 0.008 |
| Perfume/Color, 10/1 | 0.1 | 0.1 |
| Water, q.s. | to 100% | to 100% |

[6]Modified Polymer F, AM/MAPTAC/SE-20-MA, 87.1/9.9/1.9
[7]Ethylene diamine triacetic acid, trisodium salt This invention has been disclosed with respect to preferred embodiments, and it will be understood that modifications and variations thereof obvious to those skilled in the art are to be included within the spirit and purview of this application and the scope of the appended claims.

What is claimed is:

1. A liquid detergent composition consisting essentially of an aqueous medium containing, approximately by weight, 5 to 50% of organic foaming non-cationic detergent material, 0 to 20% aromatic sulfonate hydrotrope, 0 to 8% of $C_{10}$–$C_{18}$ alkanoic acid $C_{2-4}$ alkanolamide foam stabilizer, and 0.1 to 10% of a cationic foam-stabilizing copolymer containing, approximately by weight, more than 50% of units derived from acrylamide, methacrylamide or a mixture thereof, 0.5 to 2% of pendant quaternary nitrogen, and 0.1 to 10% of pendant $C_{8-24}$ hydrophobic groups.

2. A composition according to claim 1 wherein said copolymer contains, approximately by weight, 55 to 95% of units derived from acrylamide, methacrylamide or a mixture thereof, 4 to 30% of hydrophilically functional units having the molecular configuration of units derived from at least one monoethylenically unsaturated, quaternary ammonium group-containing monomer, and 1 to 15% of units derived from at least one monoethylenically unsaturated, $C_{8-24}$ hydrophobic group-containing monomer devoid of quaternary nitrogen.

3. A composition according to claim 2 wherein said quaternary ammonium group-containing monomer has the formula

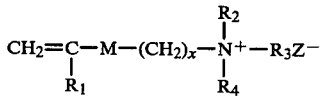

wherein $R_1$ is H or $CH_3$,
$R_2$ and $R_3$ are independently $C_{1-4}$ alkyls,
$R_4$ is $C_{1-4}$ alkyl, $C_{2-3}$ hydroxyalkyl, or benzyl
$R_2$, $R_3$ and $R_4$ together contain less than 9 carbon atoms,
Z is a water-solubilizing salt-forming anion, and
M may be —CO—X—, then X is —O— or —$NR_5$—, $R_5$ is H or $C_{1-4}$ alkyl and x is 1–6, or
M may be phenylene then x is 1.

4. A composition according to claim 3 wherein in said quaternary ammonium group-containing monomer, $R_1$, $R_2$, $R_3$ and $R_4$ are $CH_3$, M is —CONH— and x is 3.

5. A composition according to claim 2 wherein said hydrophobic group-containing monomer has the formula

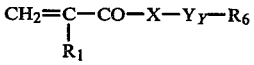

wherein $R_1$ is H or $CH_3$,
X is —O— or —$NR_7$—,
Y is —$C_2H_4O$— or —$C_3H_7O$—,
y is 0–60,
when X is —O—, $R_6$ is $C_{8-24}$ hydrocarbyl, and
when X is —$NR_7$—, $R_6$ is $C_{1-24}$ hydrocarbyl and $R_7$ is H or $C_{1-24}$ hydrocarbyl, at least one of $R_6$ and $R_7$ being $C_{8-24}$ hydrocarbyl.

6. A composition according to claim 5 wherein in said hydrophobic group-containing monomer, X is —O—, Y is —$C_2H_4O$—, y is 20, $R_1$ is $CH_3$ and $R_6$ is $C_{16-18}$ alkyl.

7. A composition according to claim 1 wherein said copolymer contains, approximately by weight, 85 to 97% of units derived from acrylamide, methacrylamide or a mixture thereof and 3 to 15% of units having the molecular configuration of units derived from at least one monoethylenically unsaturated monomer containing quaternary ammonium and $C_{8-24}$ hydrophobic groups.

8. A composition according to claim 7 wherein said unsaturated monomer has the formula

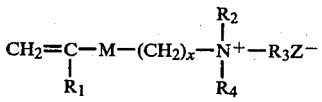

wherein $R_1$ is H or $CH_3$,
$R_2$ and $R_3$ are independently $C_{1-4}$ hydrocarbyl,
$R_4$ is $C_{8-24}$ hydrocarbyl,
Z is a water solubilizing salt-forming anion, and
M may be —CO—X—, then X is —O— or —NR—$_5$, $R_5$ is H or $C_{1-4}$ alkyl and x is 1–6, or
M may be phenylene, then x is 1.

9. A composition according to claim 8 wherein, in said unsaturated monomer, $R_1$, $R_2$ and $R_3$ are $CH_3$, $R_4$ is dodecylbenzyl, M is —CONH— and x is 3.

10. A composition according to claim 8 wherein in said unsaturated monomer, $R_1$ and H, $R_2$ and $R_3$ are $CH_3$, $R_4$ is tetradecyl, M is phenylene and x is 1.

11. A composition according to claim 2 wherein said copolymer contains, approximately by weight 70 to 90% of units derived from acrylamide, 8 to 25% of units derived from methacrylamidopropyl trimethyl ammonium chloride, and 1 to 8% of units derived from stearyl (oxyethylene)$_{20}$ methacrylate.

12. A composition according to claim 1 containing about 10 to about 40 wt. % of one or a mixture of anionic detergents.

13. A composition according to claim 12 wherein said anionic detergents are selected from the group consisting of salts of $C_{10-20}$ alkyl benzene sulfonates, $C_{10-20}$ alkyl (oxyethylene)$_{2-30}$ sulfates, $C_{10-20}$ alkyl sulphates, paraffin sulfonates, and mixtures thereof.

14. A composition according to claim 12 containing a mixture of salts of $C_{10-20}$ alkyl benzene sulfonates and $C_{10-20}$ alkyl (oxyethylene)$_{2-30}$ sulfates in an approximate weight ratio of 1:1 to 2:1.

15. A composition according to claim 1 containing about 2 to about 5 wt. % of said alkanolamide foam stabilizer.

16. A composition according to claim 15 wherein said alkanolamide foam stabilizer comprises lauric/myristic mono- or di-ethanolamides or mixtures thereof.

17. A composition according to claim 1 containing about 3 to about 12 wt. % of aromatic sulfonate hydrotrope.

18. A composition according to claim 17 wherein said hydrotrope comprises salts of xylene, cumene or toluene sulfonates or mixtures thereof.

19. A composition according to claim 1 containing about 3 to about 20 wt. % of ethanol.

20. A composition according to claim 11 containing, approximately by weight, 0.5 to 5% of said copolymer, 10 to 40% of one or a mixture of anionic detergents, 2 to 5% of said alkanolamide foam stabilizer, and 3 to 12% of aromatic sulfonate hydrotrope.

* * * * *